US010450824B1

(12) United States Patent
Sokolow

(10) Patent No.: US 10,450,824 B1
(45) Date of Patent: Oct. 22, 2019

(54) METHOD AND APPARATUS FOR A DOWN HOLE BLOW OUT PREVENTER

(71) Applicant: Mark Terry Sokolow, Webster, TX (US)

(72) Inventor: Mark Terry Sokolow, Webster, TX (US)

( * ) Notice: Subject to any disclaimer, the term of this patent is extended or adjusted under 35 U.S.C. 154(b) by 75 days.

(21) Appl. No.: 15/399,707

(22) Filed: Jan. 5, 2017

Related U.S. Application Data

(60) Provisional application No. 62/392,053, filed on May 18, 2016.

(51) Int. Cl.

| | |
|---|---|
| ***E21B 33/10*** | (2006.01) |
| ***E21B 21/10*** | (2006.01) |
| ***E21B 34/08*** | (2006.01) |
| ***E21B 33/12*** | (2006.01) |
| ***E21B 33/126*** | (2006.01) |
| ***E21B 33/06*** | (2006.01) |

(52) U.S. Cl.
CPC ..... *E21B 33/10* (2013.01); *E21B 21/103* (2013.01); *E21B 33/06* (2013.01); *E21B 33/12* (2013.01); *E21B 33/126* (2013.01); *E21B 34/08* (2013.01)

(58) Field of Classification Search
CPC ..... E21B 21/103
See application file for complete search history.

(56) References Cited

U.S. PATENT DOCUMENTS

| | | | | |
|---|---|---|---|---|
| 6,296,056 | B1 * | 10/2001 | Ward | E21B 21/08 166/250.07 |
| 2008/0060846 | A1 * | 3/2008 | Belcher | E21B 17/042 175/25 |
| 2012/0312548 | A1 * | 12/2012 | Swist | E21B 21/10 166/373 |

* cited by examiner

*Primary Examiner* — David J Bagnell
*Assistant Examiner* — Tara E Schimpf
(74) *Attorney, Agent, or Firm* — Mark Sokolow

(57) ABSTRACT

The invention is a method and apparatus, automatic down hole blow out preventer wherein external elastomer rings are placed on the exterior of a grooved section of drill pipe. Below the external elastomer rings is an external pressure deflector ring, which is designed to be lifted up in a kick. When a kick occurs, the increased pressure will force the external pressure deflector ring up, causing the external elastomer rings to flip up and out as to inhibit or block the further flow of fluid up the annulus.

5 Claims, 19 Drawing Sheets

METHOD AND APPARATUS FOR A DOWN HOLE BLOW OUT PREVENTER

I hereby claim the benefit of a Provisional patent application filed on May 18, 2016 (Application No. 62/392,053).

BACKGROUND AND SUMMARY OF THE INVENTION

This invention is customized as to when the drilling operator is about to break into the seal or go into a formation which has unexpected pore pressures or fracture gradients. The seal is the impermeable rock barrier, under which the oil and/or gas is trapped. Once this seal is pierced, oil and/or gas can flow up through the well bore to the surface. Nevertheless, it is usually only estimated as to the exact depth, thickness and width of the seal as well as the vertical pressure thereunder. Thus, it can pose a danger to the drilling operator who is managing the pressures of the drilling operation who wishes to avoid a blowout. Also, petroleum engineers drill within a safety margin marked by an estimated pore pressure and by an estimated fracture gradient, with the weight of the mud (drilling fluid) and the frictional pressure of the drilling itself acting as to balance the pressure. If the mud weight and frictional pressure are too low, there could be a kick in that the pore pressure of the adjacent formation would exceed it. If the mud weight and frictional pressure are too high, it could exceed the fracture gradient and the formation can be damaged. Most drilling operations have blow out preventers at or near the surface. The flow of fluid up the drill string is already protected by back flow devices i.e. down hole float valves or IBOP (inside blow out preventers), which are in common use. This invention, the automatic down hole blow preventer is down hole and it can be activated by the early detection of the increased pressure of a kick. This early increased pressure will cause the activation of the external pressure deflector ring, which will flip up and out the external elastomer rings as to inhibit or block the further flow of fluid up the annulus. The automatic down hole blow out preventer works without mechanical valves, balls or other possible obstructions to the normal flow of mud in drilling operations and it is applicable to prevent an unexpected flow up the annulus. Depending on the elastomer used and the pressure of the kick, the automatic down hole blow out preventer can either block the kick or at least temporarily restrain the kick up the annulus until the surface blow out preventer is activated.

Figure 4:
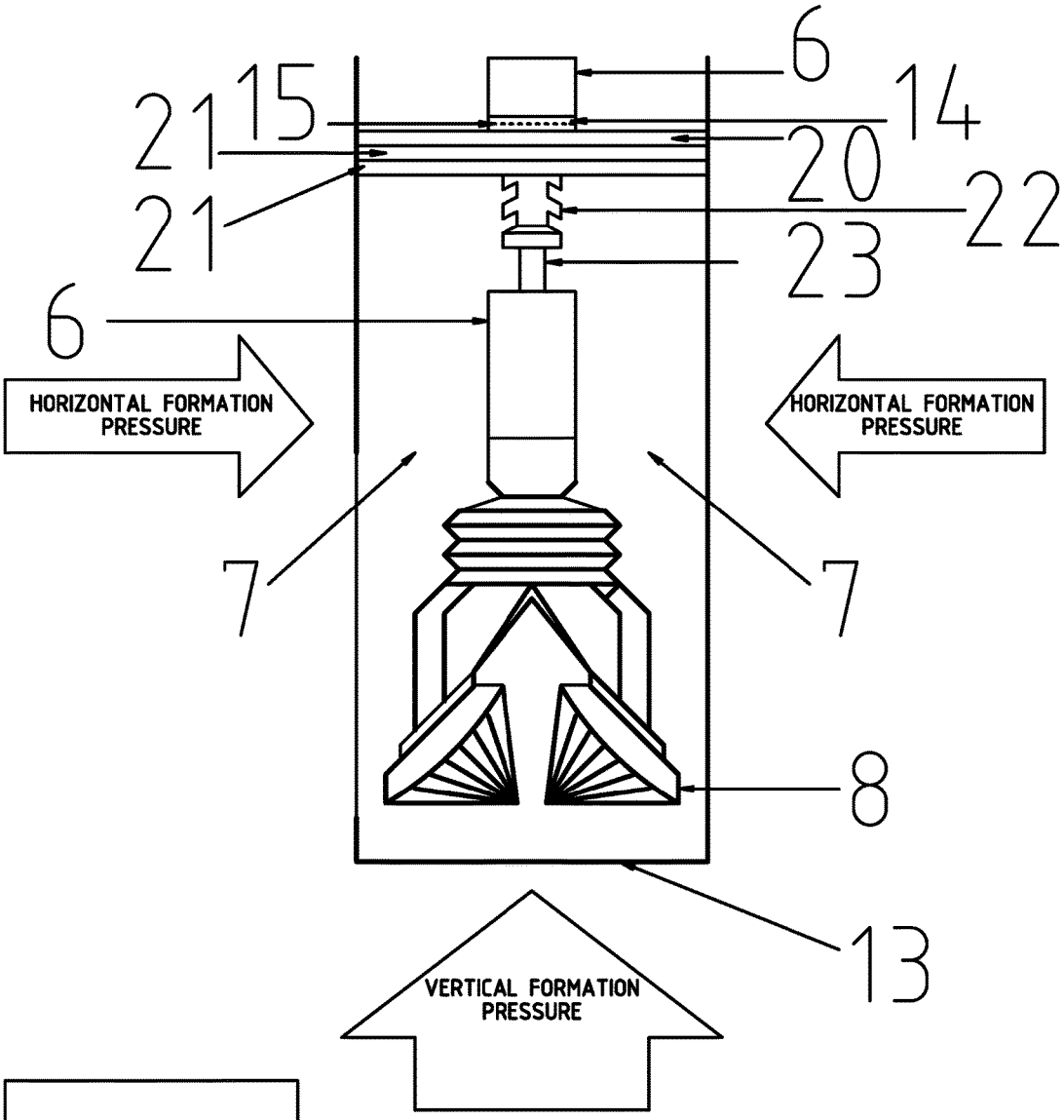
FIG. 4 shows the activated external elastomer rings, which have been flipped up and out. Elastomer is defined as the material that is referred to as elastomer in the chemical industry or similar materials with substantially the same properties. Flipped up and out is exemplified as where the outer portion of an elastomer ring is moved away from the drill pipe and is stretched out toward the casing or toward the bore hole as to seal the annulus.
Figure 5:
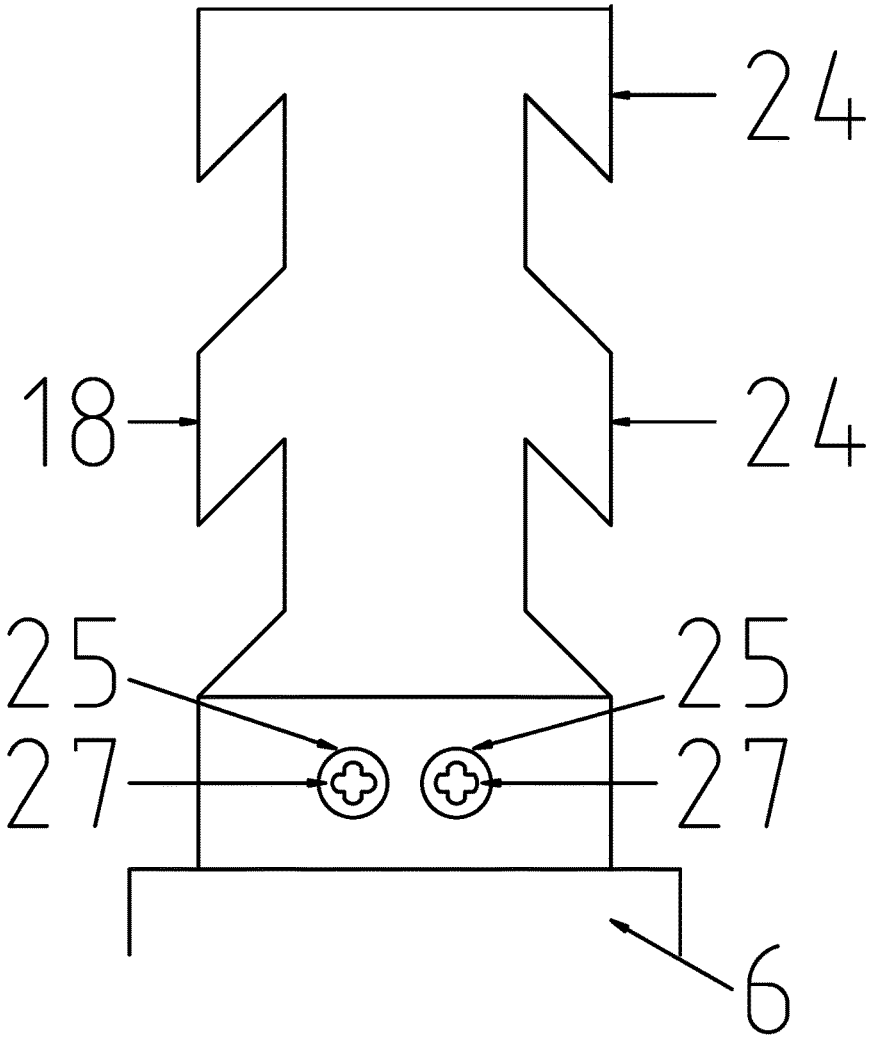
FIG. 5 shows the peg release sub-system, in an unactivated state, holding the external pressure deflector ring.
Figure 6:
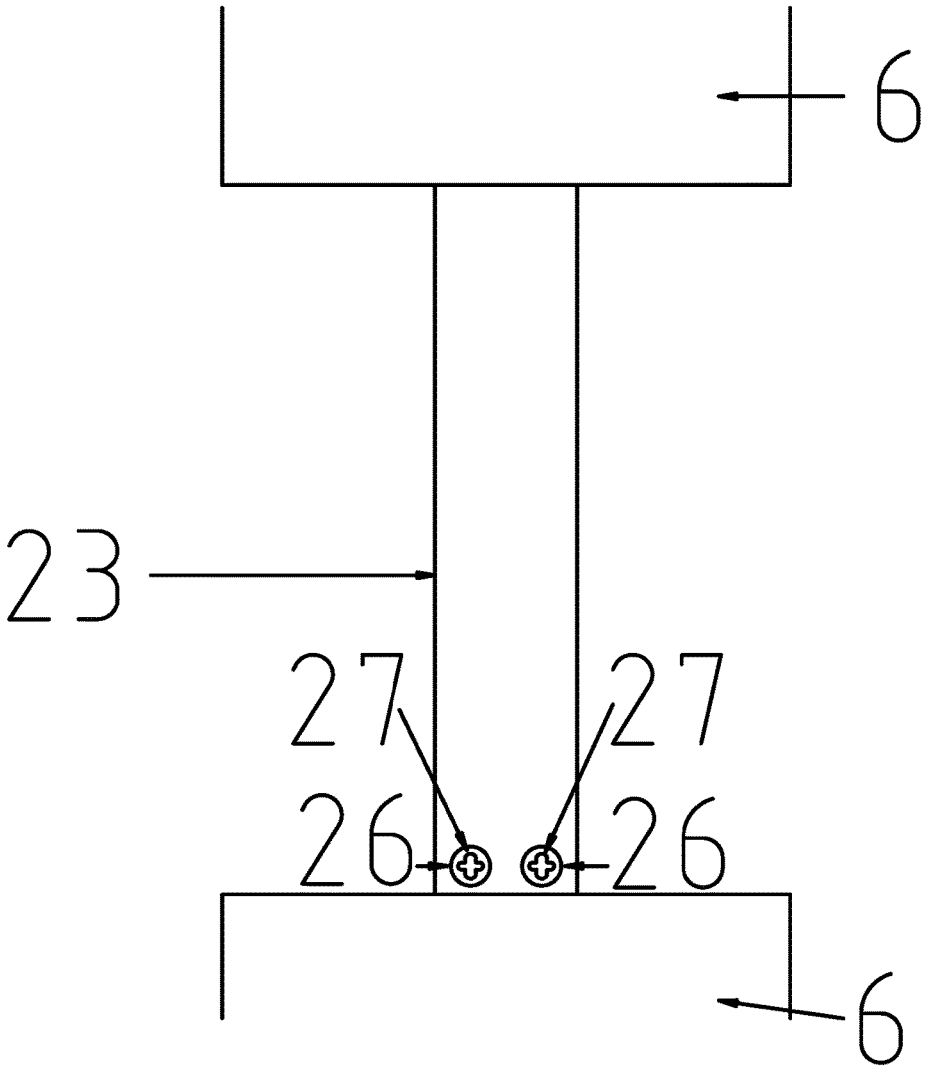
FIG. 6 shows the peg release sub-system on a grooved out section of the drill string.
Figure 7:
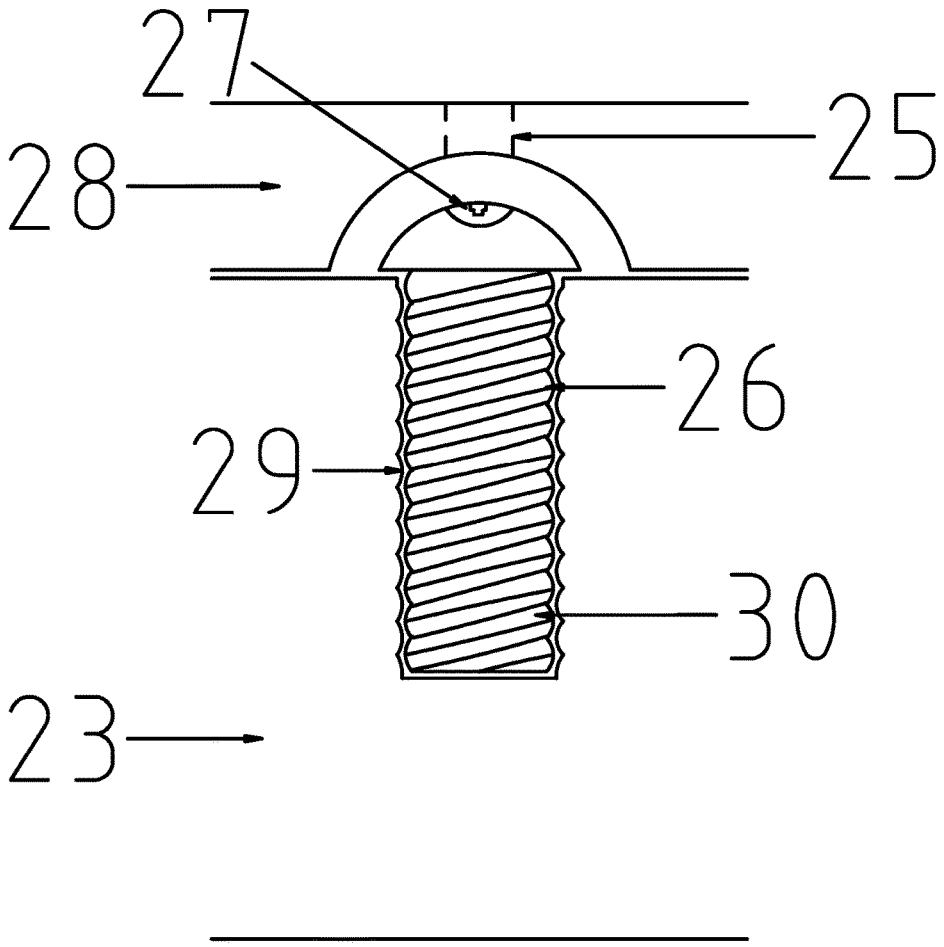
FIG. 7 shows a peg that is adjustable as to height that is inserted into a screw base in the grooved portion of a section of the drill string.
Figure 8:
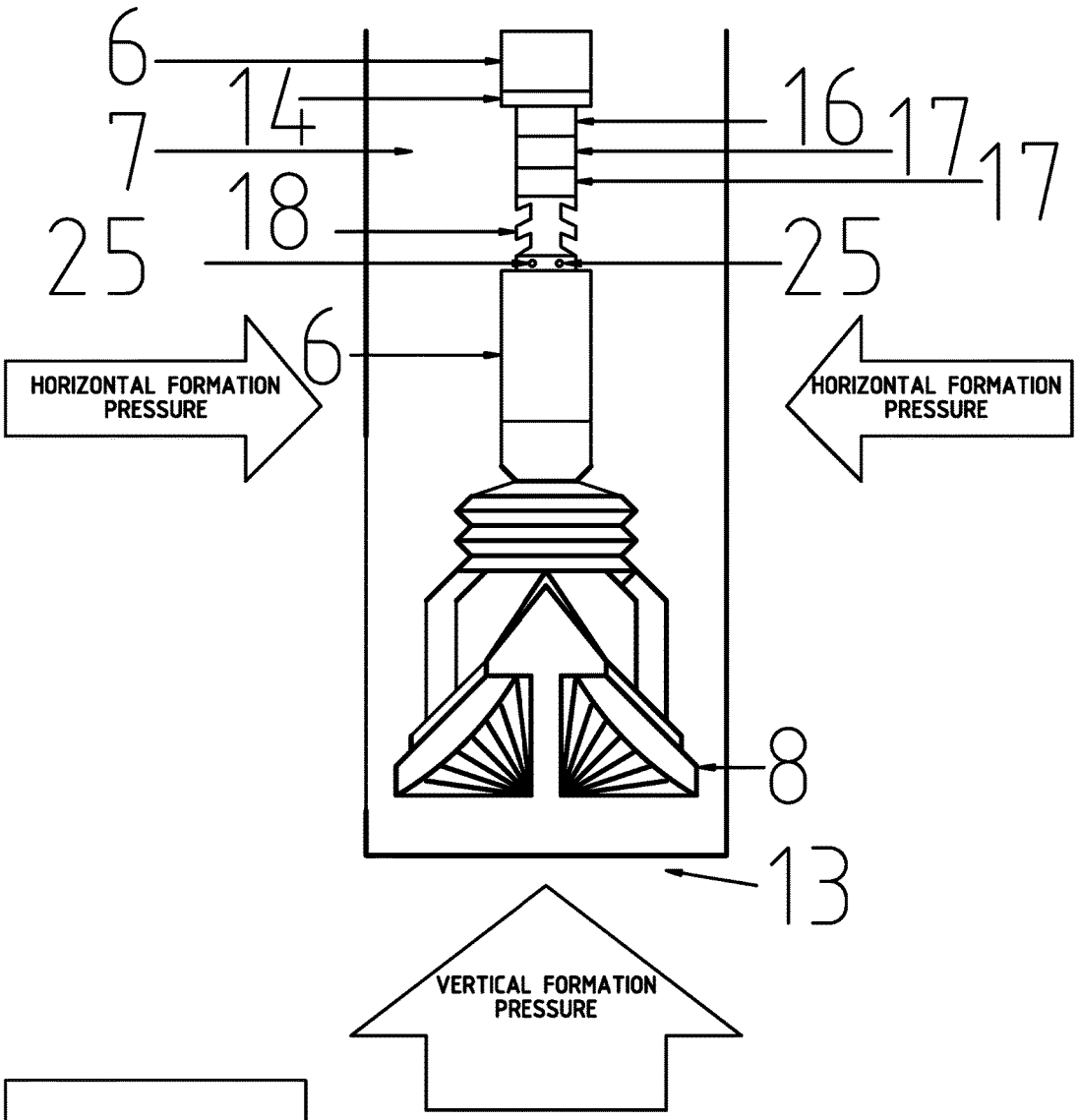
FIG. 8 shows the peg release sub-system in an unactivated state on the drill string.
Figure 9:
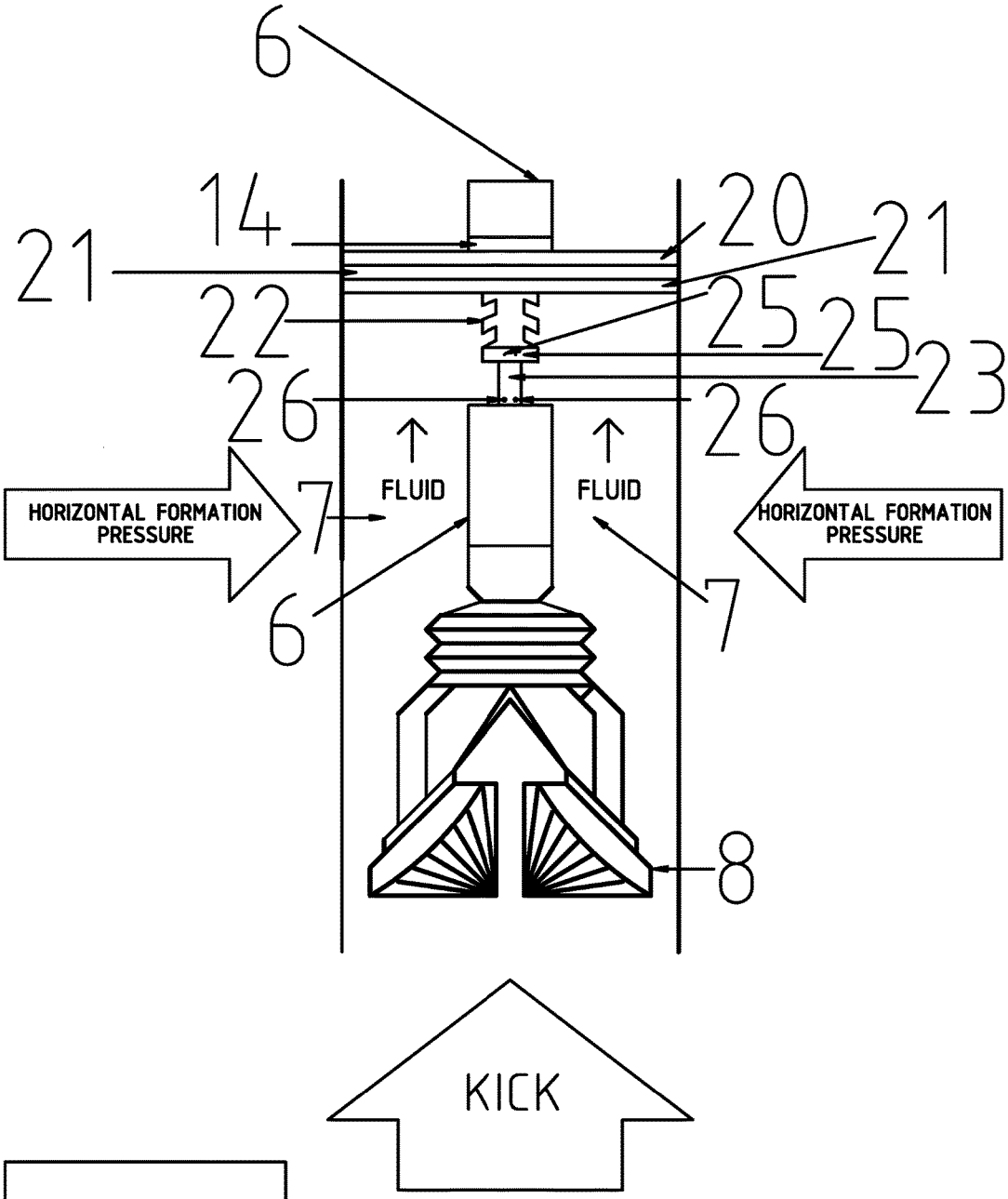
FIG. 9 shows the peg release sub-system in an activated state.
Figure 10:
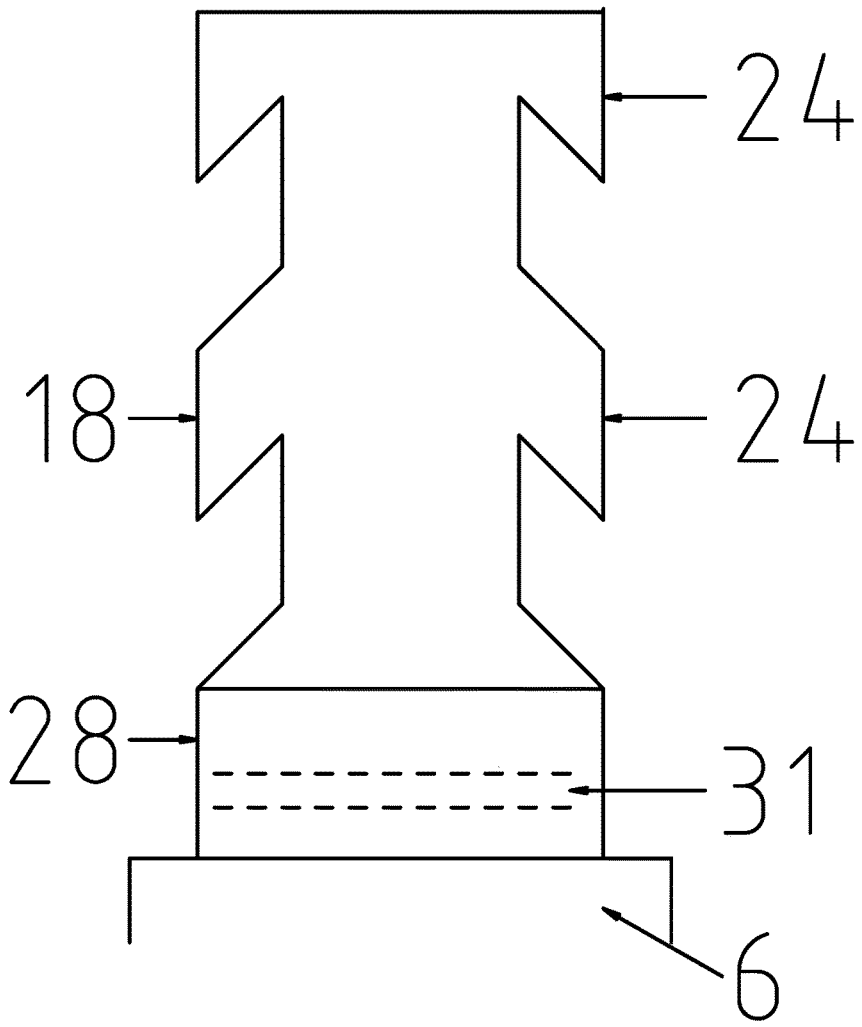
FIG. 10 shows the rim release sub-system in an unactivated state.
Figure 11:
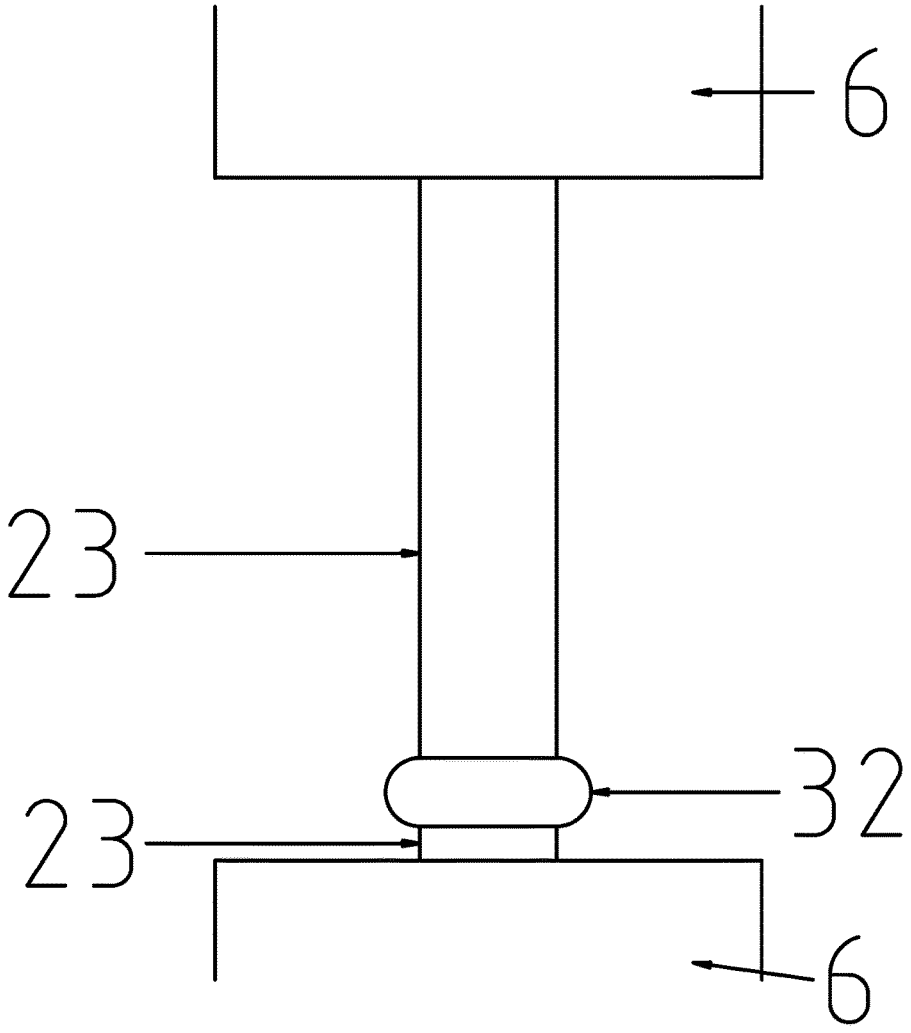
FIG. 11 shows the circular raised rim of the rim release sub-system.
Figure 12:
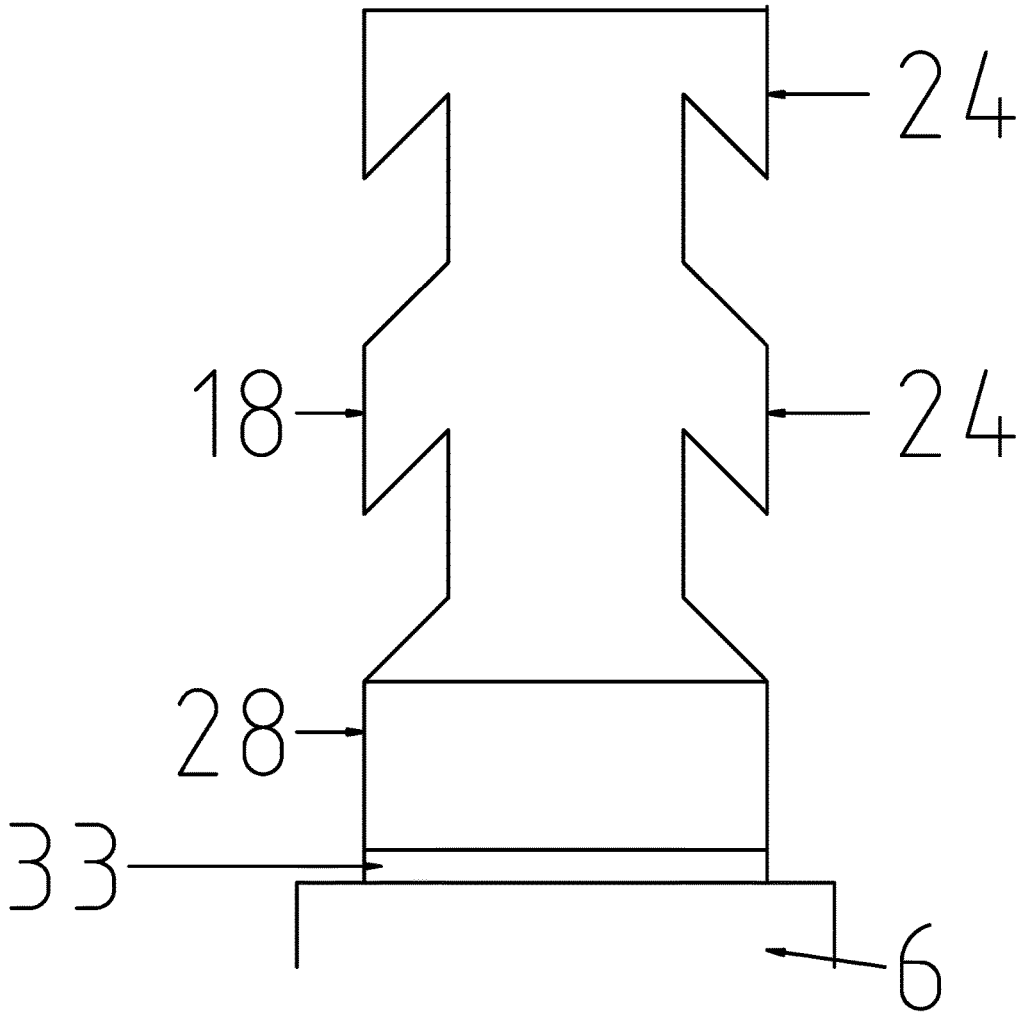
FIG. 12 shows the weld release sub-system in an unactivated state.

The automatic downhole blow out preventer system is composed of the following:

a. External elastomer rings as delineated in FIG. 3 (unactivated external elastomer ring). When activated, the external elastomer rings will flip up and out, thus blocking or inhibiting the passage of fluid in the annulus. The width of the first external elastomer ring will be at least the width of the annulus, plus an additional width as to be fitted under the permanent external metal ring.
b. Permanent external metal ring as delineated in FIG. 3, which acts to hold the upper portion of the first External Elastomer Ring from flying off when there is a kick.
c. Additional external elastomer rings as delineated in FIG. 3, with at least the width of the annulus, and with enough combined strength as to (when activated) block or inhibit the flow of the fluid up the annulus. An illustration of activated external elastomer rings are again delineated in FIG. 4.
d. External pressure deflector ring as delineated in FIGS. 3 and 4, which is designed to lift up the external elastomer rings.

e. Grooved section of the drill string to hold the external elastomer rings and the external pressure deflector ring as shown in FIG. 4.

f. An automatic release system so that the external pressure deflector ring will automatically be released from its position on the drill string (when the safety threshold pressure is reached) and the external pressure deflector ring will then move and push up and out the external elastomer rings as to block or inhibit the flow of fluid up the annulus g. The automatic release system can be installed with the release mechanism being a breakaway metal shield ring as described in FIGS. 13 to 17. The metal shield ring is welded in place and the welds are designed to break or fail at the safety threshold pressure. This system has the advantage of protecting the external elastomer rings and external pressure deflector ring during drilling operations from abrasive mud and cuttings. It can also allow an extension of the cusps of the pressure deflector ring as described in FIGS. 18 and 19. It has the disadvantage of the welds could be damaged by normal drilling operations. Therefore, the rate of penetration and rotation speed of the drill string may need to be adjusted as to reduce the possibility of damage to the welds. A modification of this system is delineated in the alternative peg release sub-system, rim release sub-system or the weld release sub-system.

h. The peg release sub-system is illustrated in FIGS. 5 to 9 with metal pegs. It has the advantage of the pegs being adjustable as to their height. It has the disadvantage that the pegs may become loose during drilling operations. Therefore, the rate of penetration and rotation speed of the drill string may need to be adjusted as to reduce the possibility that the pegs may be jostled and their heights modified by drilling operations.

i. The rim release sub-system is illustrated in FIGS. 10 and 11. It has the advantage of having less parts and therefore, having a lower chance of failure. It also has the advantage that the height thereof will not be adjusted during drilling operations. It has the disadvantage of not being adjustable once the rim is installed or set in place on the drill string.

j. The weld release sub-system is illustrated in FIG. 12. It has the advantage of having fewer parts, and the weld is simply installed to break at a safety threshold pressure. It has the disadvantage of the weld could be damaged by normal drilling operations. Therefore, the rate of penetration and rotation speed of the drill string may need to be adjusted as to reduce the possibility that the weld may be damaged during drilling operations. The rate of penetration is exemplified as the penetration rate or drill rate and is the speed at which a drill bit breaks the rock under it to deepen the bore hole. The rotation speed of the drill string is exemplified as the speed of rotation of the drill string rotating around its axis and is the number of turns of the drill string divided by time, specified as revolutions per minute (rpm).

TECHNIQUES

Figure 1:
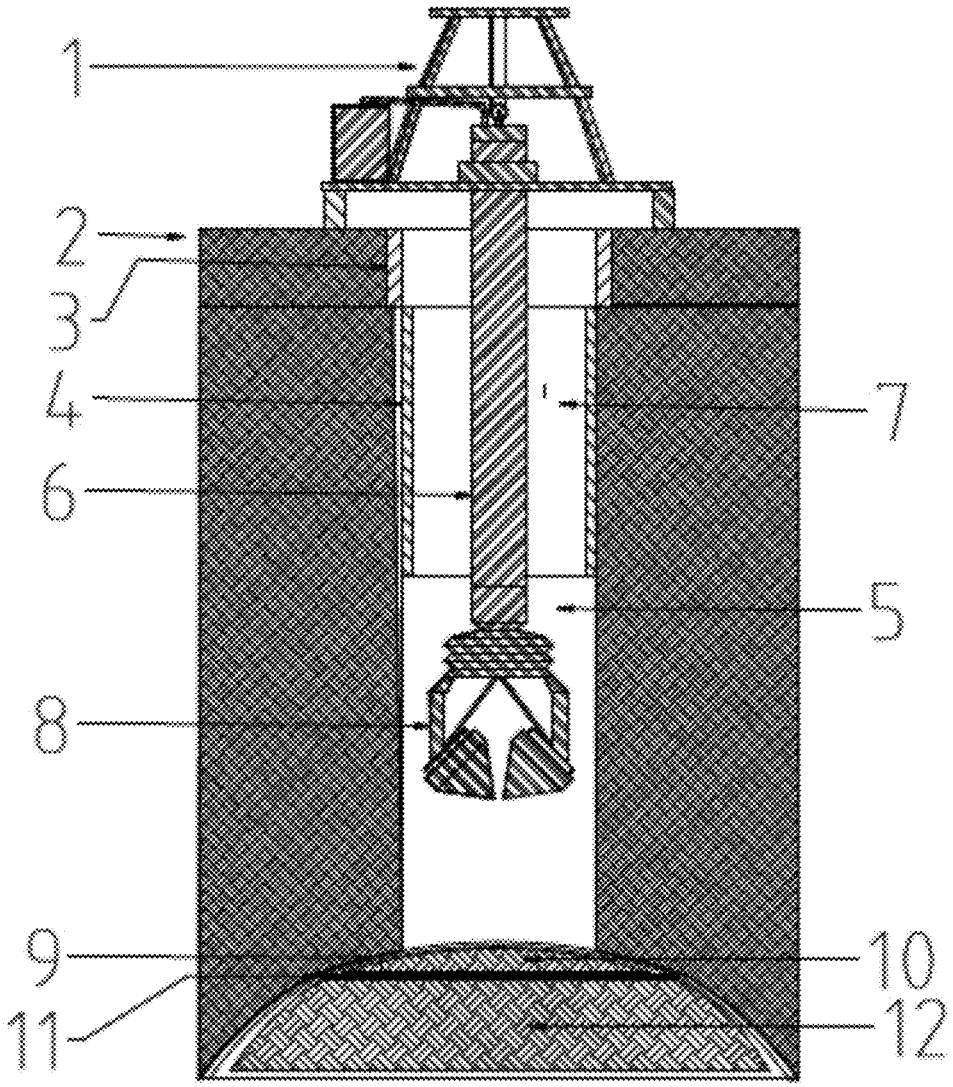
FIGURE 1 PRIOR ART
FIG. 1 shows an overview of the oil and gas well as well as the drill string, which is about to pierce the seal of the oil and associated gas reservoir.
Figure 2:
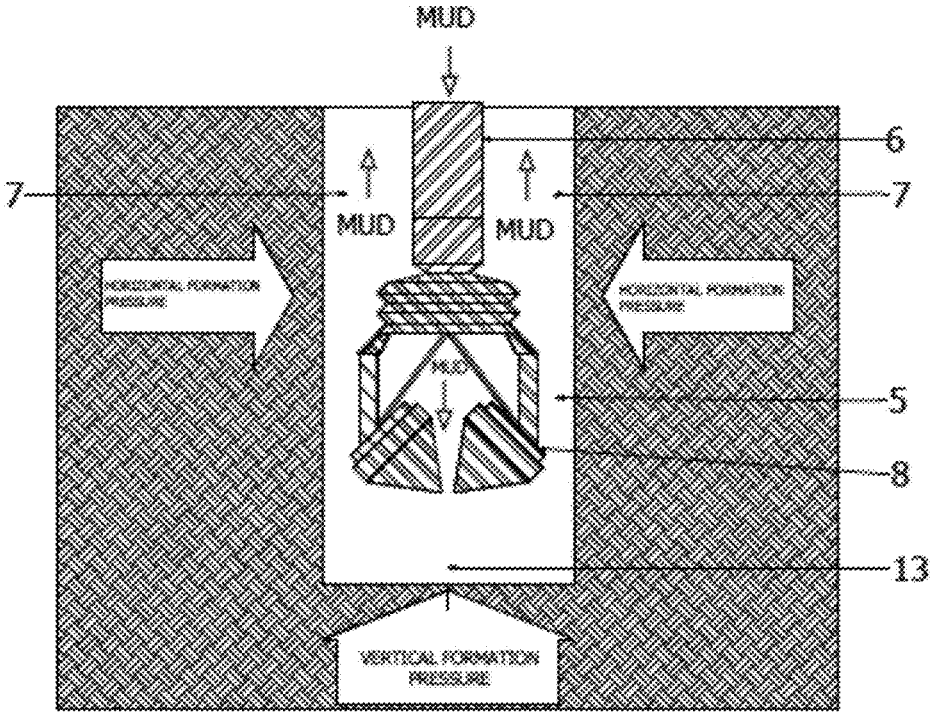
FIGURE 2 PRIOR ART
FIG. 2 shows the typical fluid flow of mud in a drill string and the balancing of pressures that is required of a drilling operator as to avoid a blow out.
Figure 3:
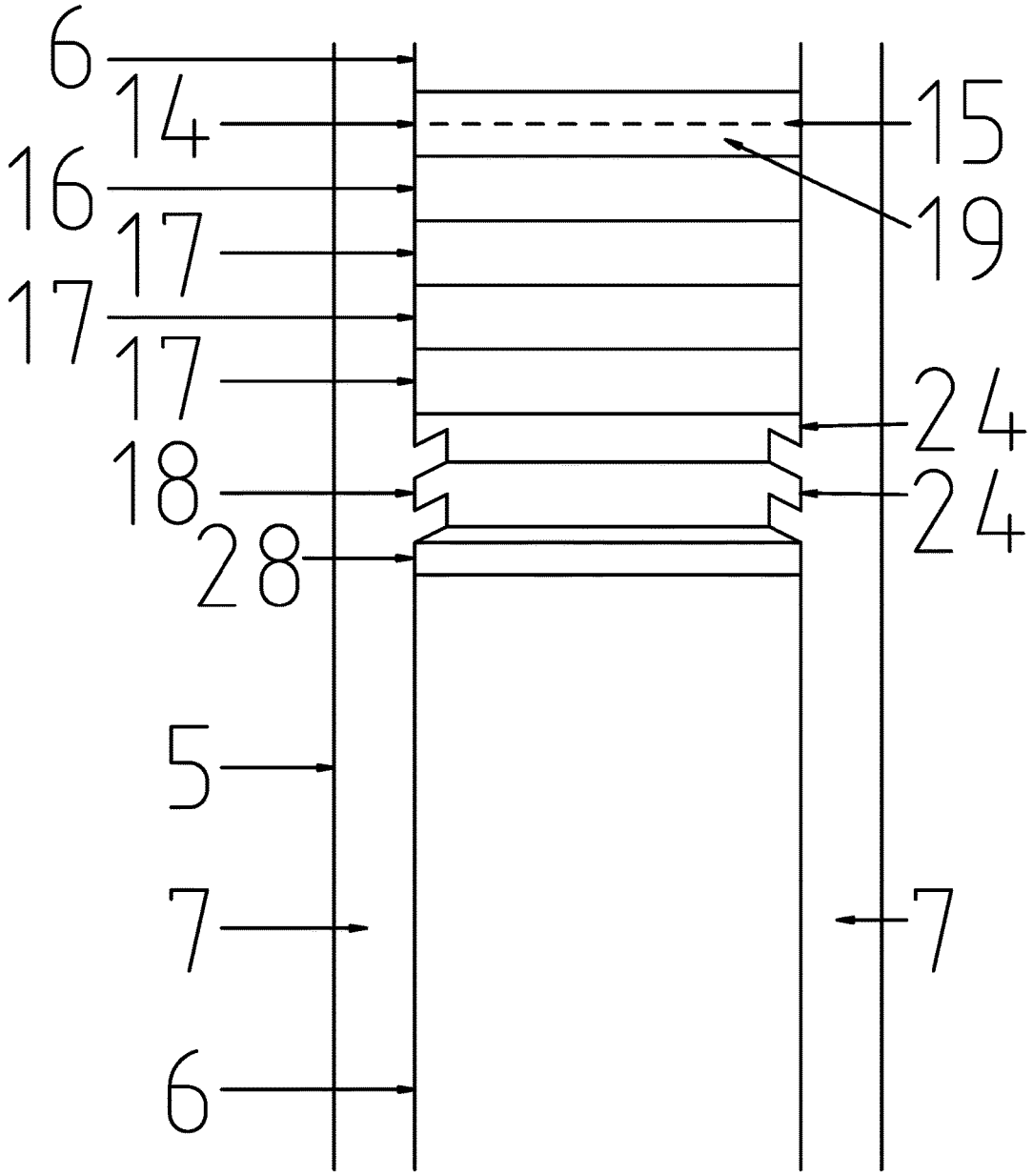
FIG. 3 shows the external elastomer rings in an unactivated state, the permanent external metal ring which acts to hold the upper portion of the first external elastomer ring from flying off when there is a kick and the external pressure deflector ring which is designed to lift up the external elastomer rings.
Figure 13:
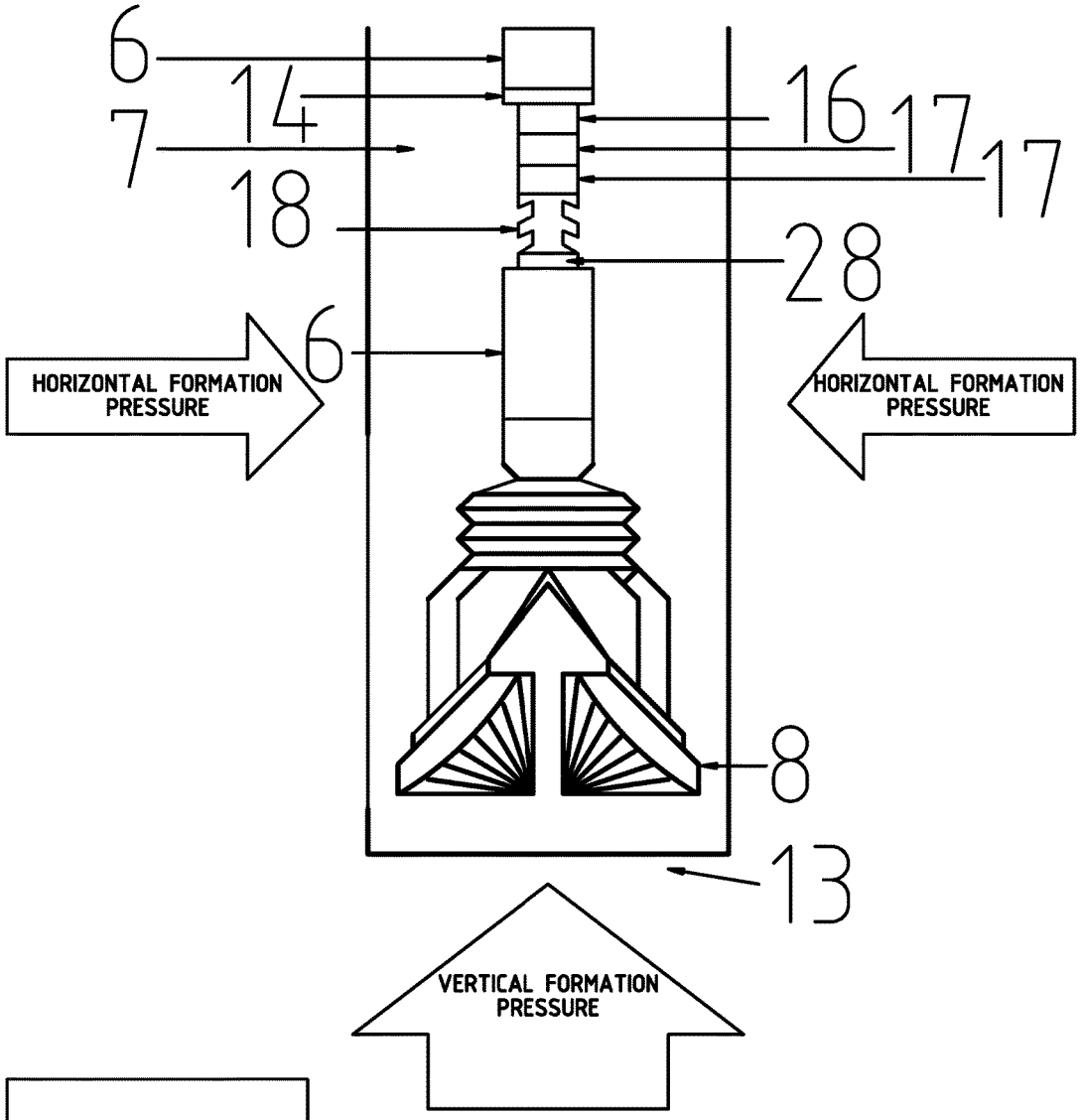
FIG. 13 shows the automatic down hole blow out preventer with a permanent external metal shield ring, external elastomer rings and an external pressure deflector ring.
Figure 14:
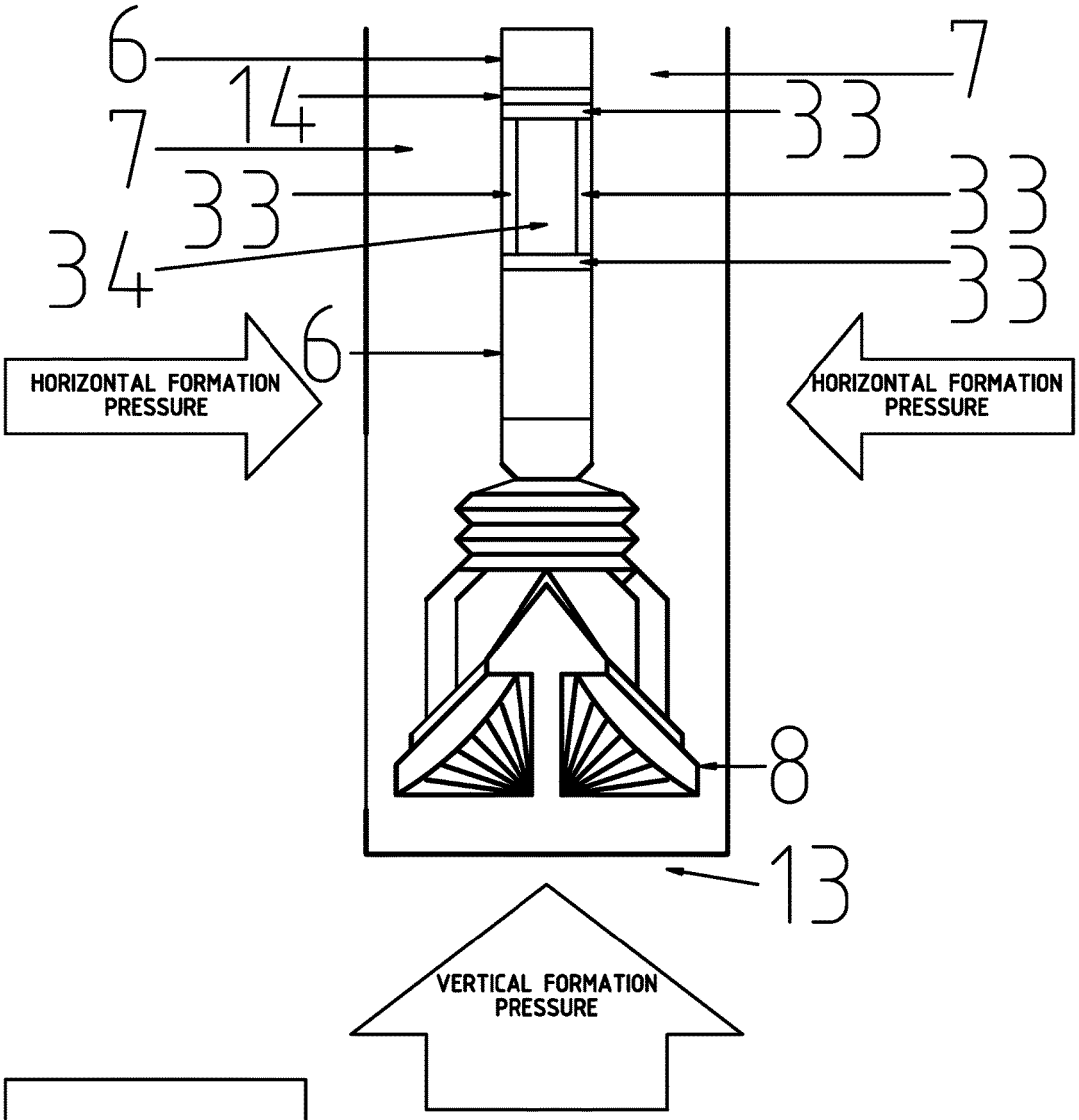
FIG. 14 shows the break away metal shield ring in un-activated state. The metal shield ring is welded in place and the welds are designed to break or fail at a safety threshold pressure.
Figure 15:
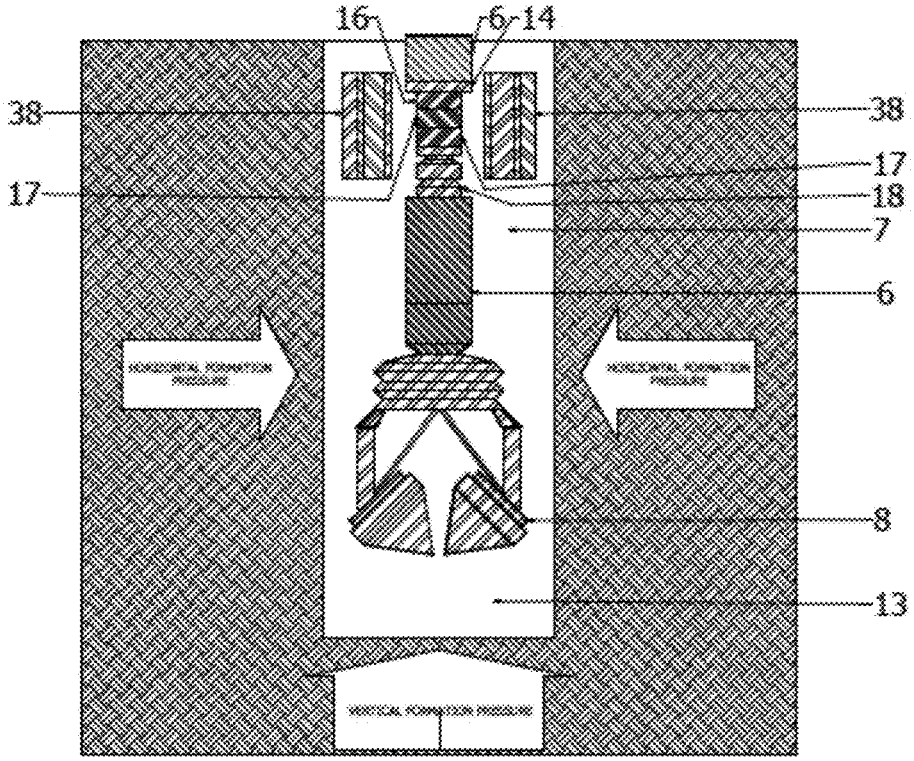
FIG. 15 shows the break away external metal shield ring in an activated state.
Figure 16:
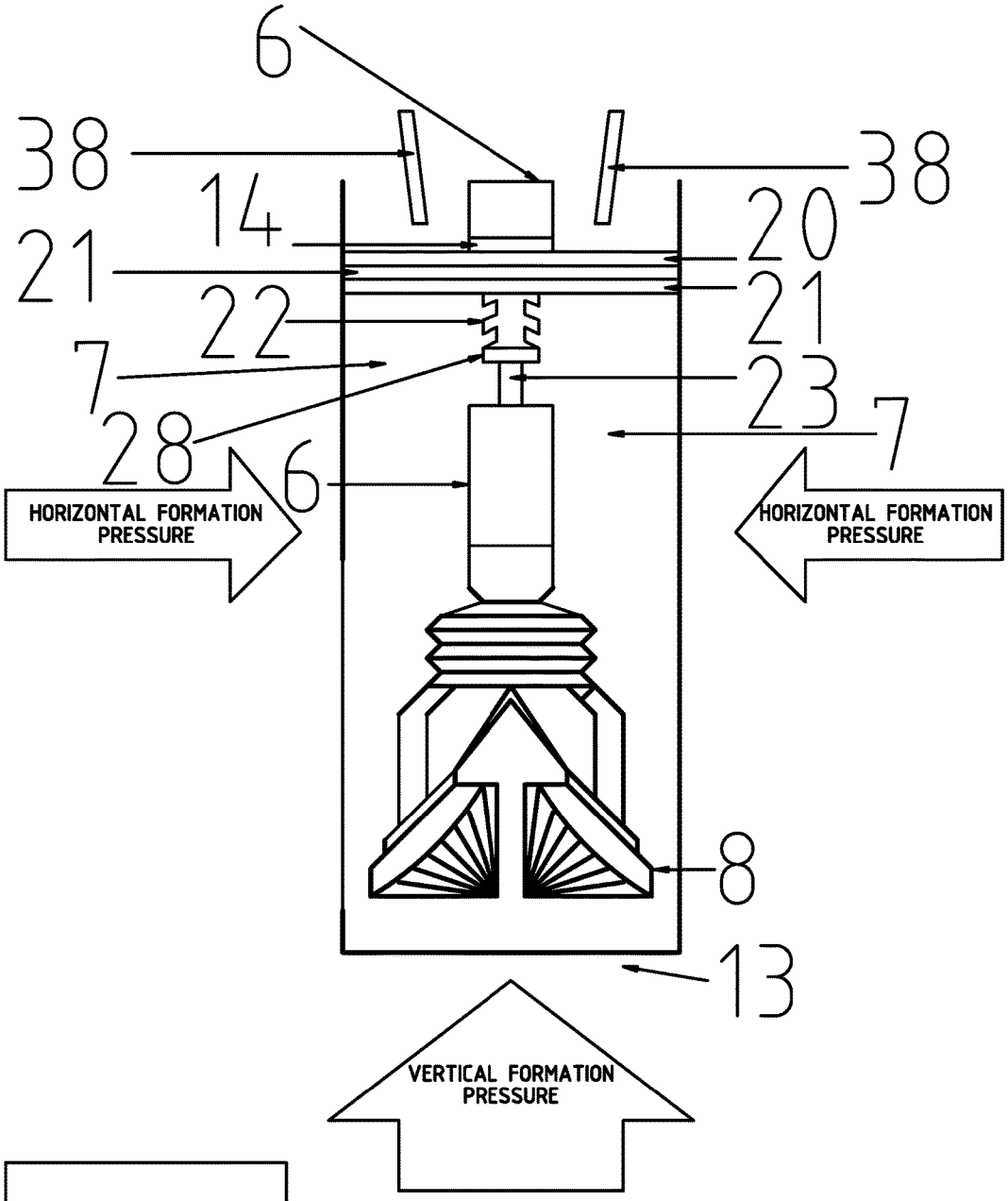
FIG. 16 shows the break away external metal shield ring in an activated state as well as the activated first external elastomer ring and activated additional external elastomer rings.
Figure 17:
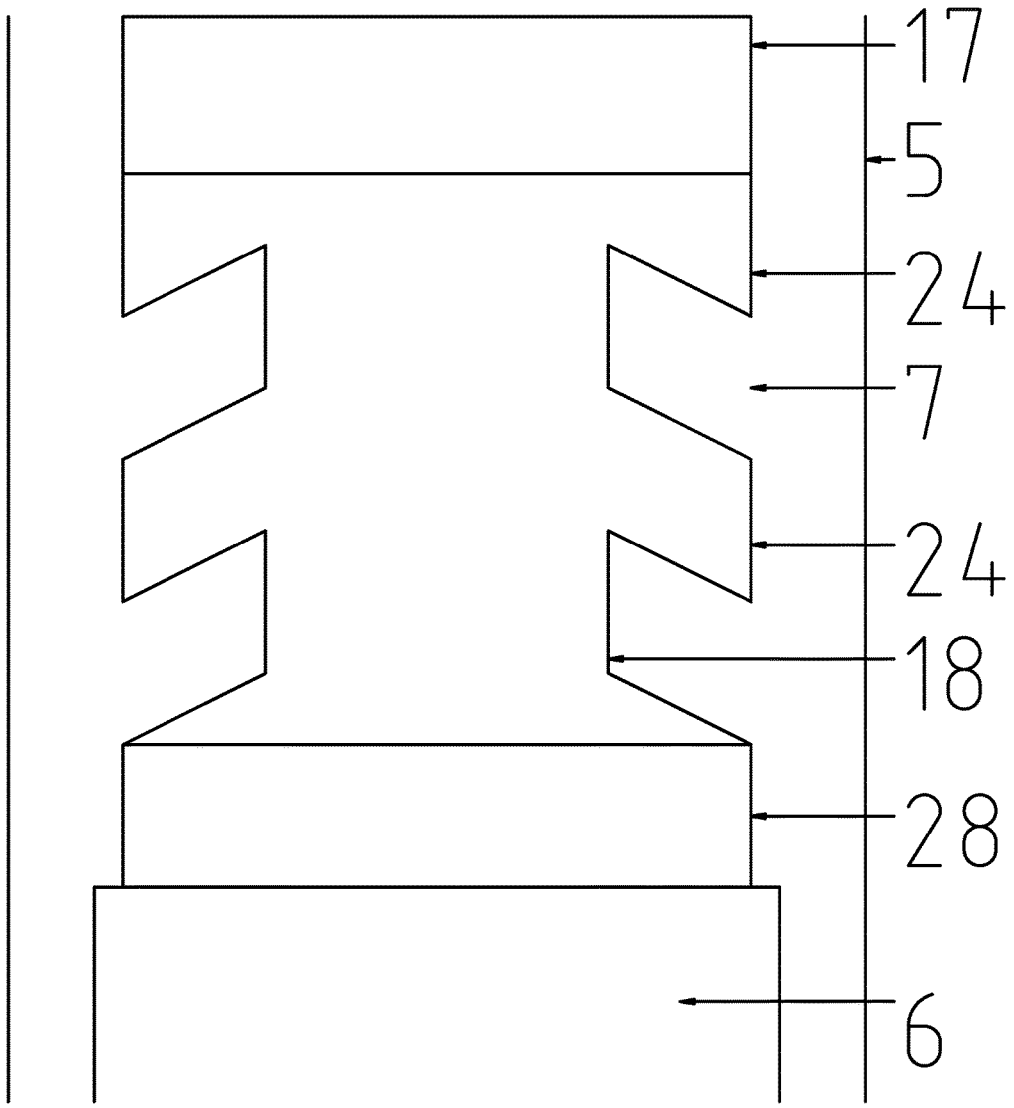
FIG. 17 shows the external pressure deflector ring without pop out extensions.
Figure 18:
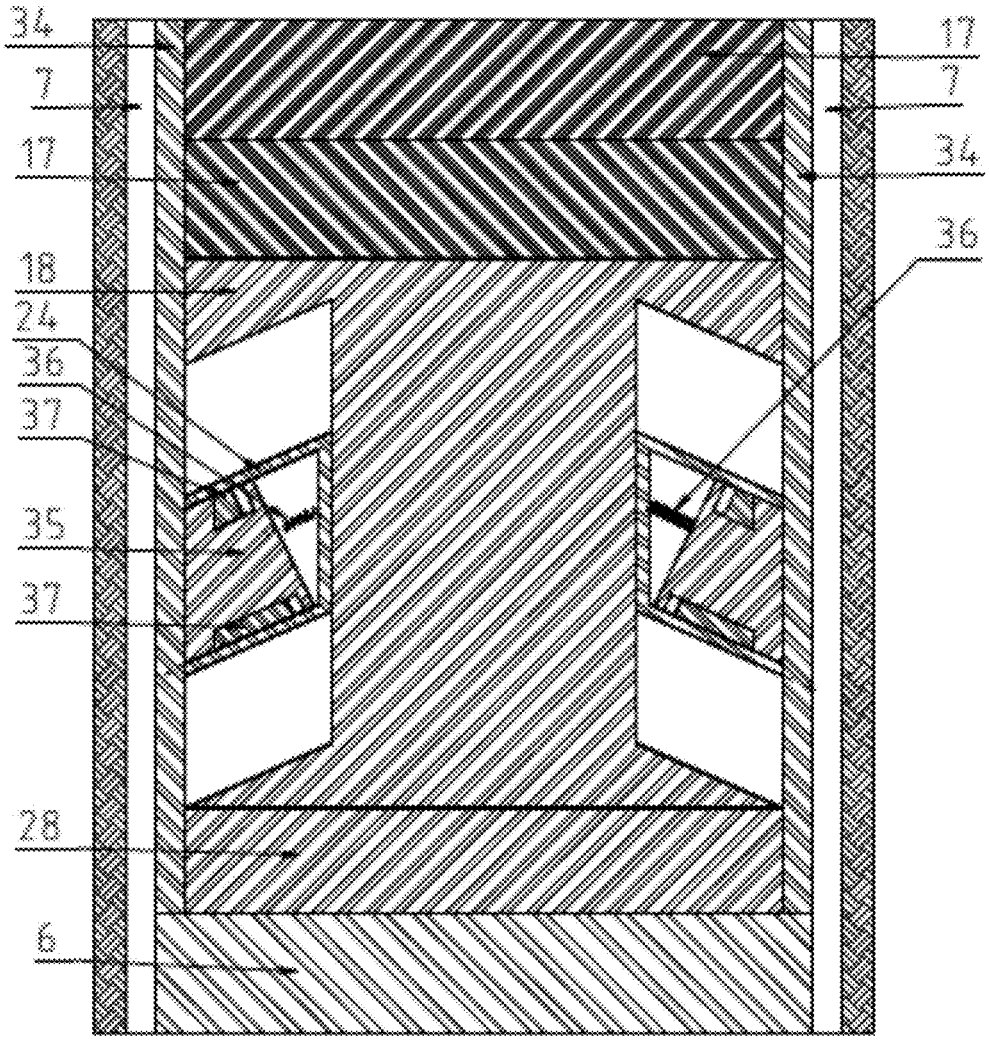
FIG. 18 shows the external pressure deflector ring with pop out extensions being held in place by the external metal shield ring.
Figure 19:
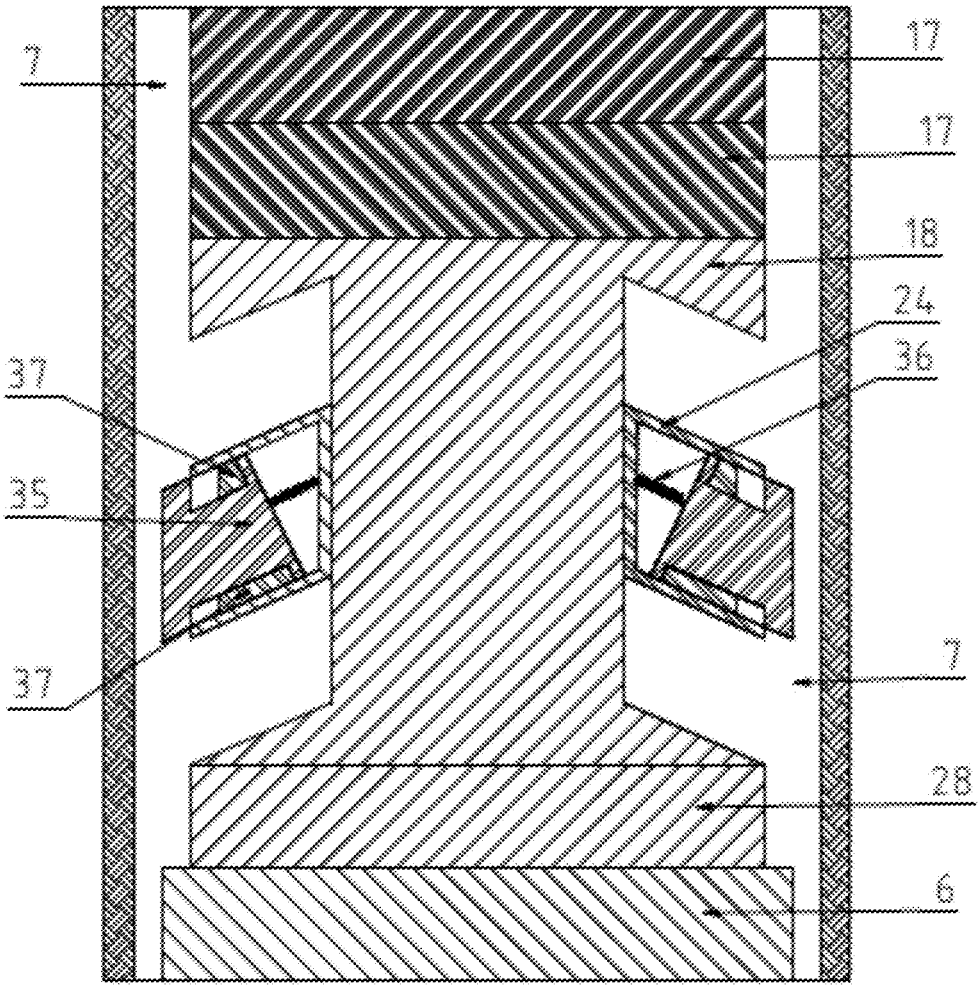
FIG. 19 shows the external pressure deflector ring with pop out extensions that have been activated after the break off of the external metal shield ring, which extends the pressure deflector cusps. The pressure deflector cusps are exemplified as the metal lips of the external pressure deflector ring that are grooved in, with an angle that can capture the fluid flow.

The inventor's technique for the automatic down hole blow out preventer system is the following:

a. The petroleum engineer will delineate his drill plan noting the proposed pore pressures and fracture margins at each depth.

b. The petroleum engineer will denote the area in the drill string, wherein the margin between the fracture (frac) gradient and the pore pressure is narrow.

c. The petroleum engineer will delineate the threshold pressure that could cause a major kick. A kick would be exemplified as a major kick that has escalated into a blow out when the formation fluid reaches the surface, especially when the influx contains gas that expands rapidly as it flows up the wellbore, further decreasing the effective weight of the mud.

d. The petroleum engineer will add a safety margin to the threshold pressure, for example 10% as to delineate the safety threshold pressure for the system to be activated.

e. The petroleum engineer will note the expected maximum width of the annulus at this depth of concern. The petroleum engineer is defined as an oil and gas professional or operator with the same or similar duties as a petroleum engineer, installing blow out preventers.

f. The overall thickness of the combined elastomer rings to block the fluid caused by a kick, will then be determined based on the stress factors of the individual elastomer rings to be used.

g. Each external elastomer ring will be at least as wide as the annulus width, with the first external elastomer ring being wider as to fit it under the permanent external metal ring, holding the top portion of the first external elastomer ring in place h. The number of pressure deflector cusps and the angle on the cusps on the pressure deflector ring will be determined based on the pressure needed to lift, flip up and out, as well as to combine all of the individual elastomer rings. In FIG. 3, two deflector cusps are described, but there can be more or less.

i. The length of the section of the drill string that will be grooved and the incremental radius of the groove will be determined as to fit the external elastomer rings and the external pressure deflector ring. The type of metal of the section of the drill string that will hold the external elastomer rings and the pressure deflector ring will be determined as it will need to be of such type that will meet or exceed the expected burst pressure, collapse pressure and tensile pressure of the drill string taking into consideration the thinnest section of the drill pipe (grooved section). The expected burst pressure is exemplified as the maximum pressure possible in the bore minus the pressure acting on the drill string towards the center axis. The collapse pressure (crush pressure) is exemplified as the maximum pressure outside the drill string minus the pressure inside the drill string. The tensile pressure is exemplified as the maximum force per cross-sectional area that can pull a drill string apart.

k. The petroleum engineer will decide which type of release sub-system that he would prefer to hold the pressure deflector ring in place until the safety threshold pressure is reached. This decision could be based on the desired rate of penetration and rotation speed of the drill string as well as the expected type of mud to be used and the expected abrasiveness of the cuttings to be generated during the drilling operation. The release sub-systems are exemplified as the following:

i. external metal shield ring release sub-system. This is composed of an external metal shield ring that covers the external elastomer rings and the external pressure deflector ring. This external metal shield ring can protect the external elastomer rings and external pressure deflector ring from the abrasive action of the mud and the cuttings during daily drilling operations. The external metal shield is also welded onto the drill string, which will stay in place until the safety threshold pressure is reached and the force thereof will break the welds and then the underlying pressure deflector ring will be automatically activated. This external metal shield ring sub-system is shown in FIGS. 13 to 17. FIG. 13 shows the external elastomer rings, permanent external metal ring and external pressure deflector ring installed on a grooved section of the drill string. In FIG. 13, there is nothing holding the external pressure deflector ring in place, from rising up when pressure is exerted on it. Also, there is a gap as to install another ring on top of that. In FIG. 14, it shows the external metal shield ring installed on top of the external pressure deflector ring and the external elastomer rings. The external metal shield ring is held in place by horizontal and vertical welds that are installed as to break upon reaching the safety threshold pressure. In FIG. 15, it shows the break-up of the external metal shield ring into at least two components. It can have additional vertical welds as to allow the external metal shield ring to break up into more than two components as to reduce the size thereof. FIG. 16 shows the automatic activation of the external pressure deflector ring (after the break-up and removal of the external metal shield ring), which moves up, flipping up and out the elastomer rings as to inhibit or block the further flow of fluid up the annulus. The external metal shield ring release sub-system also has the additional advantage of being able to have deflector pop out extensions as shown in FIGS. 17, 18 and 19, with FIG. 17 showing external pressure deflector ring without the pop out extensions, FIG. 18 showing external pressure deflector ring with extensions being held in place by the external metal shield ring and FIG. 19 showing the external pressure deflector ring with pop up extensions that have been activated after the break off of the external metal shield ring. The size and number of these pop up extensions vary based on the anticipated worst-case scenario of a major kick or blow out. The extensions are inserted into the pressure deflector ring. It is spring based. As the external metal shield ring separates and breaks off, the extensions automatically pop out. It size and strength is customized as to the expected holding strength of the external metal shield ring. The amount of extension of the pop out is stopped and held by lips as shown in FIGS. 18 and 19.

ii. metal peg release sub-systems, wherein pegs are located on the grooved section of the drill string which will hold the external pressure deflector ring in place until the safety threshold pressure is reached and the force thereof, will push the external pressure deflector ring over and past the pegs. The height, diameter and number of pegs can be set as needed to match the expected safety threshold pressure. The height can be adjusted by raising or lowering the peg in a screw base that is imbedded in the drill string. The external pressure deflector ring can have a small hole above each peg as to allow the insertion of a screwdriver as to raise or lower the peg. The peg release sub-system is shown in FIGS. 5 to 9.

iii. rim release sub-system, wherein a circular raised rim is located on the grooved section of the drill string, which will hold the external pressure deflector ring in place until the safety threshold pressure is reached and the force thereof, will push the external pressure deflector ring over and past the circular raised rim. The height and width of the circular raised rim can be set as needed to match the safety threshold pressure. This rim sub-system is shown in FIGS. 10 and 11.

iv. weld release sub-system, wherein the external pressure deflector ring is simply welded onto the grooved section of the drill string, which will hold the external pressure deflector ring in place until the safety threshold pressure is reached and the force thereof will break the weld and the external pressure deflector ring will move up. The weld will be installed per American Welding Society (AWS) requirements or similar industry standards as to break when the safety threshold pressure is reached. This weld sub-system is shown in FIG. 12.

l. Determine the location in the drill string as to insert the automatic down hole blow out preventer.

m. The external elastomer rings, permanent external metal ring, external pressure deflector ring and release sub-system are installed in a grooved section of drill pipe thus creating the automatic down hole blow out preventer.

n. The grooved section of drill pipe with the automatic down hole blow out preventer is then inserted into the drill string as an additional protection against a major kick.

DETAILED DESCRIPTION OF THE PREFERRED EMBODIMENT

The inventor's first technique is designed to work as an automatic safety mechanism in the form of an automatic downhole blow out preventer that will be automatically activated when the safety threshold pressure is reached. In other words, a kick is occurring, mud, cuttings and formation fluid are coming up the annulus at a pressure and speed that can possibly cause a blow out if the mud, cuttings and formation fluid are not inhibited or blocked at an early stage. If the blow out pressure is determined hypothetically at 4000 psi, the safety threshold pressure could be set at 3600 psi. The number of pegs has hypothetically already been set around the grooved section of drill string at degree intervals of 0, 45, 90, 135, 180, 225, 270 and 315 degrees. The height of the pegs can be adjusted so that the pressure deflector ring is not released or able to bypass the pegs until the 3600 psi (pounds per square inch) is reached. Once the 3600 psi is reached, the external pressure deflector ring is forced passed the pegs and lifted up. When the external pressure deflector ring is lifted up, it flips up and out as well as combines the individual external elastomer rings, which will block or inhibit the further flow of fluid up the annulus. This will give additional time, if needed for the rig crew to also activate the blow out preventer at the surface as an additional safety precaution. The best mode for carrying out the invention is for the automatic down hole blow out preventer to be inserted near the end of the drill string. It is not necessarily advisable to have it immediately before the drill bit as turbulence of the drill bit and the mud cuttings may possibly damage it. The exact location would have to be customized based on the expected flow of the mud, the abrasive nature of the expected cuttings, the location of the centralizers and the condition of the annulus. Abrasive nature is exemplified as the tendency of a material to shape or finish through grinding, rubbing or contact another material.

TABLE OF FIGS.

| FIG. | DESCRIPTION |
|---|---|
| 1 | Overview of oil and gas well |
| 2 | Typical fluid flow in drill string |
| 3 | External elastomer rings and external pressure deflector ring |
| 4 | Activated external elastomer rings with lifted up external pressure deflector ring |
| 5 | External pressure deflector ring with peg release sub-system |
| 6 | Pegs on grooved drill pipe |
| 7 | Side view of peg release sub-system in grooved out portion of drill string |
| 8 | Automatic down hole blow out preventer (external elastomer rings, external pressure deflector ring and peg release sub-system) |
| 9 | Grooved pipe with automatic down hole blow out preventer (activated external elastomer rings and lifted up external pressure deflector ring, utilizing peg release sub-system) |
| 10 | External pressure deflector ring with rim release sub-system |
| 11 | Rim on grooved drill pipe to be utilized in rim release sub-system |
| 12 | External pressure deflector ring with weld release sub-system |
| 13 | External metal shield ring sub-system (before installation of external metal shield ring) |
| 14 | External metal shield ring sub-system (after installation of metal shield ring) |
| 15 | External metal shield ring sub-system (showing break up of external metal shield ring) |
| 16 | External metal shield ring sub-system (Showing automatic activation of external pressure deflector ring after break up of external metal shield ring) |
| 17 | External pressure deflector ring without pop up extensions |
| 18 | External pressure deflector ring with pop out extensions being held in place by external metal shield ring |
| 19 | External pressure deflector ring with activated pop out extensions |

ITEMS DESCRIBED IN FIGS.

| | |
|---|---|
| 1 | Drill rig |
| 2 | Surface |
| 3 | Conductor casing |
| 4 | Surface casing |
| 5 | Well bore |
| 6 | Drill string |
| 7 | Annulus |
| 8 | Drill bit |
| 9 | Seal |
| 10 | Associated gas |
| 11 | Gas oil contact |
| 12 | Oil |
| 13 | Bottom of well bore |
| 14 | Permanent external metal ring |
| 15 | The first external elastomer ring is fitted under the permanent external metal ring to this line |
| 16 | External elastomer ring (first) |
| 17 | Additional external elastomer ring |
| 18 | External pressure deflector ring |
| 19 | Portion of first external elastomer ring that is fitted under the permanent external metal ring (14) up to the line (15) |

-continued

ITEMS DESCRIBED IN FIGS.

| | |
|---|---|
| 20 | Activated first external elastomer ring |
| 21 | Additional activated external elastomer ring |
| 22 | Activated external pressure deflector ring (Item 18) is pushed up grooved section of drill string |
| 23 | Grooved out portion of drill string |
| 24 | Cusp of external pressure deflector ring |
| 25 | Insertion hole in base of external pressure deflector ring as to raise and lower a peg |
| 26 | Peg |
| 27 | Screw fittings on top of peg |
| 28 | Base of external pressure deflector ring |
| 29 | Screw base in grooved section of drill string to fit peg |
| 30 | Groove on peg as to allow screwing the peg into the screw base |
| 31 | Groove in external pressure deflector ring over circular raised rim |
| 32 | Circular raised rim |
| 33 | Weld |
| 34 | External metal shield ring |
| 35 | Pop out extension |
| 36 | Spring pertaining to pop out extension |
| 37 | Lip pertaining to pop out extension |
| 38 | External Metal shield ring debris |

What is claimed is:

1. A method for operating or actuating an automatic down hole blow out preventer in a drill string, said method comprising the steps of:

a. delineating a drill plan for a planned drilling of an oil and gas well noting a proposed pore pressure and a fracture margin at each depth;

b. denoting a depth in the drill string, wherein a margin between a fracture gradient and a pore pressure is narrow and a possible kick could occur;

c. delineating a threshold pressure that could cause the kick;

d. adding a safety margin to the threshold pressure to delineate a safety threshold pressure for the automatic down hole blow out preventer system to be activated or operated as to block or inhibit the further flow of fluid up the annulus;

e. noting an expected maximum width of an annulus at a depth of concern;

f. determining an overall combined thickness of a plurality of external elastomer rings that will be needed to flip up and out, thus blocking or inhibiting the passage of fluid up the annulus caused by the kick, based on a stress factor of the individual external elastomer rings to be used;

g. delineating a width of each external elastomer ring, which will be at least as wide as the annulus width, with a first external elastomer ring being wider as to fit a top portion thereof under a permanent external metal ring, holding the top portion of the first external elastomer ring in place on a section of drill pipe;

h. determining a number and an angle of pressure deflector cusps on an external pressure deflector ring so that the external pressure deflector ring will automatically be released from its position on the section of drill pipe when the safety threshold pressure is reached and the external pressure deflector ring will then move and push up and out and combine the external elastomer rings as to block or inhibit the flow of fluid up the annulus;

i. determining a length of a groove and an incremental radius of the groove that is needed to be cut in the section of drill pipe as to fit the permanent metal external ring, the external elastomer rings and the external pressure deflector ring containing the pressure deflector cusps on a grooved section of drill pipe;

j. determining a type of metal of the section of drill pipe that will hold the permanent external metal ring, the external elastomer rings and the external pressure deflector ring containing the pressure deflector cusps as it will need to be of such type that will meet or exceed an expected burst pressure, a collapse pressure and a tensile pressure of the rest of the drill string taking into consideration the grooved section;

k. determining an expected rate of penetration, a rotation speed of the drill string, an expected mud to be used and an expected abrasive nature of the cuttings generated during drilling;

n. determining a location to install the section of drill pipe along a drill string;

o. installing the external elastomer rings, the permanent external metal ring and the external pressure deflector ring on the grooved section of drill pipe and p. inserting the section of drill pipe containing the automatic down hole blow out preventer on the drill string into the well.

2. A method for operating or actuating an automatic down hole blow out preventer in a drill string, said method comprising the steps of:

a. delineating a drill plan for a planned drilling of an oil and gas well noting a proposed pore pressure and a fracture margin at each depth;

b. denoting a depth in the drill string, wherein a margin between a fracture gradient and a pore pressure is narrow and a possible kick could occur;

c. delineating a threshold pressure that could cause the kick;

d. adding a safety margin to the threshold pressure to delineate a safety threshold pressure for the automatic down hole blow out preventer system to be activated or operated as to block or inhibit the further flow of fluid up the annulus;

e. noting an expected maximum width of an annulus at a depth of concern;

f. determining an overall combined thickness of a plurality of external elastomer rings that will be needed to flip up and out, thus blocking or inhibiting the passage of fluid up the annulus caused by the kick, based on a stress factor of the individual external elastomer rings to be used;

g. delineating a width of each external elastomer ring, which will be at least as wide as the annulus width, with a first external elastomer ring being wider as to fit a top portion thereof under a permanent external metal ring, holding the top portion of the first external elastomer ring in place on a section of drill pipe;

h. determining a number and an angle of pressure deflector cusps on an external pressure deflector ring so that the external pressure deflector ring will automatically be released from its position on the section of drill pipe when the safety threshold pressure is reached and the external pressure deflector ring will then move and push up and out and combine the external elastomer rings as to block or inhibit the flow of fluid up the annulus;

i. determining a length of a groove and an incremental radius of the groove that is needed to be cut in the section of drill pipe as to fit the permanent metal external ring, the external elastomer rings and the external pressure deflector ring containing the pressure deflector cusps on a grooved section of drill pipe;

j. determining a type of metal of the section of drill pipe that will hold the permanent external metal ring, the external elastomer rings and the external pressure deflector ring containing the pressure deflector cusps as it will need to be of such type that will meet or exceed an expected burst pressure, a collapse pressure and a tensile pressure of the rest of the drill string taking into consideration the grooved section;

k. determining an expected rate of penetration, a rotation speed of the drill string, an expected mud to be used and an expected abrasive nature of the cuttings generated during drilling;

l. determining in a metal peg release sub-system the height, diameter and number of pegs that can be located in the grooved section of drill pipe which will hold the external pressure deflector ring in place on the grooved section of drill pipe until the safety threshold pressure is reached and a force thereof, will push the external pressure deflector ring over and past the pegs which will flip up and out as well as combine the individual external elastomer rings as to block or inhibit the further flow of fluid up the annulus;

m. determining a location to install the section of drill pipe along a drill string;

n. installing the external elastomer rings, the permanent external metal ring, the external pressure deflector ring and the metal peg release sub-system on the grooved section of drill pipe and o. inserting the section of drill pipe containing the automatic down hole blow out preventer on the drill string into the well.

3. A method for operating or actuating an automatic down hole blow out preventer in a drill string, said method comprising the steps of:

a. delineating a drill plan for a planned drilling of an oil and gas well noting a proposed pore pressure and a fracture margin at each depth;

b. denoting a depth in the drill string, wherein a margin between a fracture gradient and a pore pressure is narrow and a possible kick could occur;

c. delineating a threshold pressure that could cause the kick;

d. adding a safety margin to the threshold pressure to delineate a safety threshold pressure for the automatic down hole blow out preventer system to be activated or operated as to block or inhibit the further flow of fluid up the annulus;

e. noting an expected maximum width of an annulus at a depth of concern;

f. determining an overall combined thickness of a plurality of external elastomer rings that will be needed to flip up and out, thus blocking or inhibiting the passage of fluid up the annulus caused by the kick, based on a stress factor of the individual external elastomer rings to be used;

g. delineating a width of each external elastomer ring, which will be at least as wide as the annulus width, with a first external elastomer ring being wider as to fit a top portion thereof under a permanent external metal ring, holding the top portion of the first external elastomer ring in place on a section of drill pipe;

h. determining a number and an angle of pressure deflector cusps on an external pressure deflector ring so that the external pressure deflector ring will automatically be released from its position on the section of drill pipe when the safety threshold pressure is reached and the external pressure deflector ring will then move and push up and out and combine the external elastomer rings as to block or inhibit the flow of fluid up the annulus;

i. determining a length of a groove and an incremental radius of the groove that is needed to be cut in the section of drill pipe as to fit the permanent metal external ring, the external elastomer rings and the external pressure deflector ring containing the pressure deflector cusps on a grooved section of drill pipe;

j. determining a type of metal of the section of drill pipe that will hold the permanent external metal ring, the external elastomer rings and the external pressure deflector ring containing the pressure deflector cusps as it will need to be of such type that will meet or exceed an expected burst pressure, a collapse pressure and a tensile pressure of the rest of the drill string taking into consideration the grooved section;

k. determining an expected rate of penetration, a rotation speed of the drill string, an expected mud to be used and an expected abrasive nature of the cuttings generated during drilling;

l. determining in a rim release sub-system the height and width of a circular raised rim that can be located in the grooved section of drill pipe which will hold the external pressure deflector ring in place on the grooved section of drill pipe until the safety threshold pressure is reached and a force thereof, will push the external pressure deflector ring over and past the circular raised rim which will flip up and out as well as combine the individual external elastomer rings as to block or inhibit the further flow of fluid up the annulus;

m. determining a location to install the section of drill pipe along a drill string;

n. installing the external elastomer rings, the permanent external metal ring, the external pressure deflector ring and the rim release sub-system on the grooved section of drill pipe and o. inserting the section of drill pipe containing the automatic down hole blow out preventer on the drill string into the well.

4. A method for operating or actuating an automatic down hole blow out preventer in a drill string, said method comprising the steps of:

a. delineating a drill plan for a planned drilling of an oil and gas well noting a proposed pore pressure and a fracture margin at each depth;

b. denoting a depth in the drill string, wherein a margin between a fracture gradient and a pore pressure is narrow and a possible kick could occur;

c. delineating a threshold pressure that could cause the kick;

d. adding a safety margin to the threshold pressure to delineate a safety threshold pressure for the automatic down hole blow out preventer system to be activated or operated as to block or inhibit the further flow of fluid up the annulus;

e. noting an expected maximum width of an annulus at a depth of concern;

f. determining an overall combined thickness of a plurality of external elastomer rings that will be needed to flip up and out, thus blocking or inhibiting the passage of fluid up the annulus caused by the kick, based on a stress factor of the individual external elastomer rings to be used;

g. delineating a width of each external elastomer ring, which will be at least as wide as the annulus width, with a first external elastomer ring being wider as to fit a top portion thereof under a permanent external metal ring, holding the top portion of the first external elastomer ring in place on a section of drill pipe;

h. determining a number and an angle of pressure deflector cusps on an external pressure deflector ring so that the external pressure deflector ring will automatically be released from its position on the section of drill pipe when the safety threshold pressure is reached and the external pressure deflector ring will then move and push up and out and combine the external elastomer rings as to block or inhibit the flow of fluid up the annulus;

i. determining a length of a groove and an incremental radius of the groove that is needed to be cut in the section of drill pipe as to fit the permanent metal external ring, the external elastomer rings and the external pressure deflector ring containing the pressure deflector cusps on a grooved section of drill pipe;

j. determining a type of metal of the section of drill pipe that will hold the permanent external metal ring, the external elastomer rings and the external pressure deflector ring containing the pressure deflector cusps as it will need to be of such type that will meet or exceed an expected burst pressure, a collapse pressure and a tensile pressure of the rest of the drill string taking into consideration the grooved section;

k. determining an expected rate of penetration, a rotation speed of the drill string, an expected mud to be used and an expected abrasive nature of the cuttings generated during drilling;

l. determining in a weld release sub-system that the external pressure deflector ring is welded onto the grooved section of drill pipe, that the weld will be installed per American Welding Society requirements or similar industry standards as to hold the external pressure deflector ring in place on the grooved section of drill pipe until the safety threshold pressure is reached and a force thereof will break the weld, the external pressure deflector ring will move up which will flip up and out as well as combine the individual external elastomer rings as to block or inhibit the further flow of fluid up the annulus;

m. determining a location to install the section of drill pipe along a drill string;

n. installing the external elastomer rings, the permanent external metal ring, the external pressure deflector ring and the weld release sub-system on the grooved section of drill pipe and o. inserting the section of drill pipe containing the automatic down hole blow out preventer on the drill string into the well.

5. A method for operating or actuating an automatic down hole blow out preventer in a drill string, said method comprising the steps of:

a. delineating a drill plan for a planned drilling of an oil and gas well noting a proposed pore pressure and a fracture margin at each depth;

b. denoting a depth in the drill string, wherein a margin between a fracture gradient and a pore pressure is narrow and a possible kick could occur;

c. delineating a threshold pressure that could cause the kick;

d. adding a safety margin to the threshold pressure to delineate a safety threshold pressure for the automatic down hole blow out preventer system to be activated or operated as to block or inhibit the further flow of fluid up the annulus;

e. noting an expected maximum width of an annulus at a depth of concern;

f. determining an overall combined thickness of a plurality of external elastomer rings that will be needed to flip up and out, thus blocking or inhibiting the passage of fluid up the annulus caused by the kick, based on a stress factor of the individual external elastomer rings to be used;

g. delineating a width of each external elastomer ring, which will be at least as wide as the annulus width, with a first external elastomer ring being wider as to fit a top portion thereof under a permanent external metal ring, holding the top portion of the first external elastomer ring in place on a section of drill pipe;

h. determining a number and an angle of pressure deflector cusps on an external pressure deflector ring so that the external pressure deflector ring will automatically be released from its position on the section of drill pipe when the safety threshold pressure is reached and the external pressure deflector ring will then move and push up and out and combine the external elastomer rings as to block or inhibit the flow of fluid up the annulus;

i. determining a length of a groove and an incremental radius of the groove that is needed to be cut in the section of drill pipe as to fit the permanent metal external ring, the external elastomer rings and the external pressure deflector ring containing the pressure deflector cusps on a grooved section of drill pipe;

j. determining a type of metal of the section of drill pipe that will hold the permanent external metal ring, the external elastomer rings and the external pressure deflector ring containing the pressure deflector cusps as it will need to be of such type that will meet or exceed an expected burst pressure, a collapse pressure and a tensile pressure of the rest of the drill string taking into consideration the grooved section;

k. determining an expected rate of penetration, a rotation speed of the drill string, an expected mud to be used and an expected abrasive nature of the cuttings generated during drilling;

l. determining in a metal shield ring release sub-system that an external metal shield ring will be welded with welds installed per American Welding Society requirements or similar industry standards to the grooved section of drill pipe as to cover and protect the external elastomer rings and external pressure deflector ring from an abrasive action of mud and cuttings during drilling operations until the safety threshold pressure is reached and a force thereof will break the welds holding the external metal shield ring to the grooved section of drill pipe as to separate and break off the external metal shield ring and the external pressure deflector ring will move up which will flip up and out as well as combine the individual external elastomer rings as to block or inhibit the further flow of fluid up the annulus;

m. determining a location to install the section of drill pipe along a drill string;

n. installing the external elastomer rings, the permanent external metal ring, the external pressure deflector ring and the metal shield release sub-system on the grooved section of drill pipe and o. inserting the section of drill pipe containing the automatic down hole blow out preventer on the drill string into the well.

* * * * *